United States Patent [19]

Miller et al.

[11] Patent Number: 5,042,790

[45] Date of Patent: Aug. 27, 1991

[54] TOGGLED SWITCH FOR USE IN A SHEET FEED APPARATUS

[75] Inventors: Gregory P. Miller; Bruce A. Winship, both of Rochester, N.Y.

[73] Assignee: Xerox Corporation, Stamford, Conn.

[21] Appl. No.: 481,146

[22] Filed: Feb. 16, 1990

[51] Int. Cl.[5] ..... B65H 7/02

[52] U.S. Cl. ..... 271/110; 271/258; 271/265

[58] Field of Search ..... 271/110, 111, 258, 259, 271/262, 263, 265, 176; 400/708; 200/332, 337, 373, 61.13, 61.18, 61.19, 61.42

[56] References Cited

U.S. PATENT DOCUMENTS

| | | | |
|---|---|---|---|
| 3,875,860 | 4/1975 | Barber | 101/217 |
| 3,902,716 | 9/1975 | Lewis . | |
| 4,390,118 | 6/1983 | Gardner, Jr. . | |
| 4,632,379 | 12/1986 | Steinhilber | 271/111 |
| 4,671,441 | 6/1987 | Hauslaib | 271/265 |
| 4,690,577 | 9/1987 | Kikuchi et al. | 400/708 |
| 4,777,729 | 10/1988 | Hausler . | |
| 4,793,605 | 12/1988 | Tajima | 271/265 |
| 4,809,969 | 3/1989 | Bastow et al. | 271/258 |
| 4,925,177 | 5/1990 | Nakamura et al. | 271/110 |

FOREIGN PATENT DOCUMENTS

| | | | |
|---|---|---|---|
| 144061 | 6/1988 | Japan | 400/708 |
| 271335 | 10/1989 | Japan | 271/265 |

OTHER PUBLICATIONS

Dicesare et al. "Paper Thickness Detection" *Xerox Disclosure Journal,* vol. 15, No. 1. Jan./Feb. 1990, pp. 57-58.

*Primary Examiner*—Robert P. Olszewski
*Assistant Examiner*—Steve Reiss

[57] ABSTRACT

A sheet transport apparatus has opposed sheet transport guide baffles defining a sheet transport path having an upstream and downstream direction and, a switch adjacent the path to detect the presence of a sheet in the path, the switch having a main switch body fixedly mounted adjacent the path, a switch actuator movable between a rest position and a switch actuated position including an actuator arm having a free end and being pivotally mounted on an actuator pivot at the other end to the main switch body and movable between a position associated with the said rest position and switch actuated position, a switch actuator tip pivotally mounted to the free end of the actuator arm and movable between a first position extending the length of the arm into said path detecting the presence of a sheet in the path and a second position pivoted toward the sheet transport upstream direction out of the sheet transport path, the actuator tip being spring biased to the first position enabling positive switch actuation by the passage of a sheet in the downstream direction of the path and passively movable to the second position against the bias by the removal of a sheet from the path in the upstream direction.

19 Claims, 5 Drawing Sheets

TOGGLED SWITCH FOR USE IN A SHEET FEED APPARATUS

BACKGROUND OF THE INVENTION

The present invention relates to a toggled switch and a sheet transport apparatus containing such a switch. In particular, it is directed to a switch that provides a positive switch actuator system in one mode of operation and a passive actuator during another mode of operation. In a particular application, the switch is used in one or more of the paper paths in an automatic electrostatographic printing machine.

In an electrostatographic reproducing apparatus commonly in use today, a photoconductive insulating member is typically charged to a uniform potential and thereafter exposed to allight image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle.

Commercial applications of this apparatus have become increasingly complex. As a result, it has become increasingly important to determine the location of paper or copy sheets in such automatic apparatus at any particular point during the imaging cycle or position of the sheet in the imaging path. This function has typically been performed by a variety of switches, detectors, sensors which detect the presence or absence of a copy sheet in one position to send a signal to the machine timing logic informing it that the sheet is or is not at a particular point in its transport path corresponding to the correct position in the timing cycle so that it can react appropriately by maintaining the automatic reproducing machine in operation or terminating the printing run or even shutting the machine down. These sensors or switches can be used to determine whether the copy sheet has left a particular station on time has arrived on time, or at any particular time is present and thereby accurately inform the machine logic. As a result of the detection of the presence and/or absence of the copy sheet at a particular location at a particular point in the timing cycle, any one of a variety of jam situations may be detected by the machine logic and their location flashed on a display to enable the operator to know the location to facilitate removal of the jammed copy sheet.

Such switches or sensors frequently have a member or arm which extends into the paper path to be contacted or displaced by a sheet being fed along the path.

When a paper jam does occur, it must be removed before normal resumption of printing activity with the automatic machine may continue. During removal of a jammed sheet, it is important to prevent damage to the jammed sheet and in particular to avoid tearing the sheet into more than one piece, one of which may not be readily easily removable by a casual operator. It is particularly important that the copy sheets not be pierced and torn in portions of the paper path where access is either very difficult, time consuming or may require the attention of a skilled operator or repairman. Unfortunately, many of the above referenced switches with arms or other members extending into the paper path suffer from difficulties with regard to piercing and tearing copy sheets and creating the jam removal problems referenced above. It is to these problems to which the present invention is directed.

PRIOR ART

U.S. Pat. No. 3,875,860 to Barber discloses a sheet sensor for an offset printer which has a mechanism to move the sensor out of a paper path if too many pieces of paper simultaneously pass by it. See col. 5, lines 34–43. The sensor has a coil spring attached to correctly bias an arm. See col. 2, line 68–col. 3, line 4. The sensor de-energizes a drive motor if too many papers pass by. See col. 4, lines 41–47.

SUMMARY OF THE INVENTION

In accordance with a principle aspect of the present invention, a switch is provided with an actuator tip which is enabled to provide positive switch actuation and is passively movable to a second position to avoid damage to a sheet during jam removal.

In a further aspect of the present invention, the switch comprises a main switch body, a switch actuator movable between a rest position and a switch actuated position including an actuator arm having a free end and being pivotally mounted at the other end to the main switch body and movable between a position associated with the rest position and the switch actuated position and having a switch actuator tip pivotally mounted to the free end of the actuator arm and movable between a first position extending the length of the arm and a second position pivoted toward the main switch body and being spring biased toward the first position enabling positive switch actuation and passively movable to a second position against the spring bias.

In a further aspect of the present invention, the switch actuator includes a second arm having a free end and being fixed to the actuator arm and pivotally mounted on the actuator pivot, the free ends of the actuator arm and the second arm being fixedly spaced apart, the second arm having a switch actuator element on its free end and the main switch body has at least one switching element which are positioned respectively on the second arm and the switch body for switching association therebetween.

In a further aspect of the present invention, at least one switch element comprises a magnetically attractable element and the switch actuator element comprises a magnet.

In a further principle aspect of the present invention, the switch is positioned adjacent said path to detect the presence of a sheet in said path.

In a further aspect of the present invention, the sheet transport guide baffles define a generally vertically oriented sheet transport path.

In a further aspect of the present invention, the switch is so mounted adjacent said transport path as to maintain the actuator in the rest position by gravity when there is no sheet in the transport path.

In a further aspect of the present invention, the apparatus includes at least one sheet drive and pinch roll pair to transport a sheet between said baffles along said transport path.

In a further aspect of the present invention, the main switch body is mounted on one side of the transport path and the actuator tip when in the rest position extends across the transport path into an opening in the opposed guide baffle forming therewith a sheet corrugating geometry.

Other features of the present invention will become apparent as the following description proceeds and upon reference to the drawings.

DETAILED DESCRIPTION OF THE PREFERRED EMBODIMENT

The invention will now to described with reference to a preferred embodiment of the toggled jam detection switch and sheet transport apparatus embodying the same.

Figure 1:
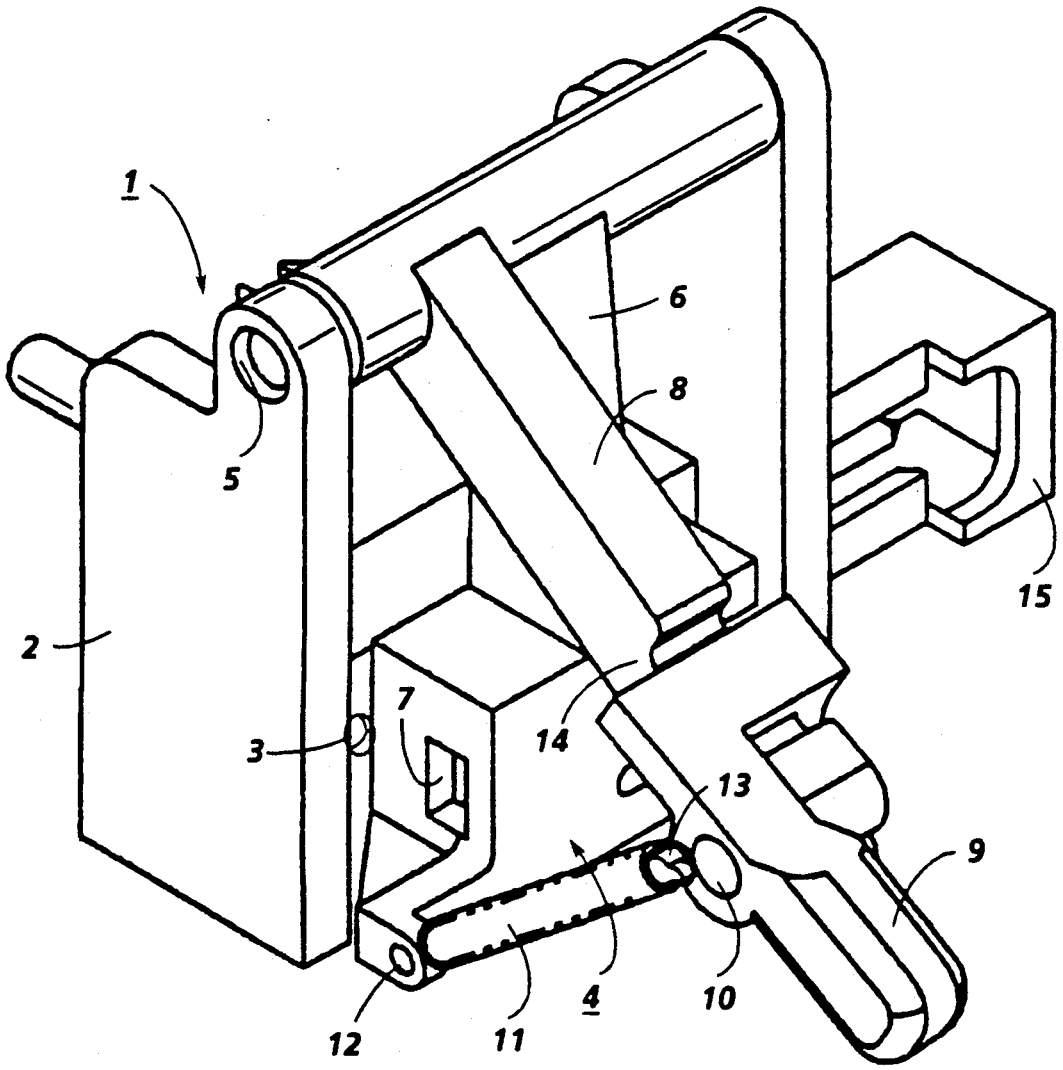
FIG. 1 is an isometric view of the switch according to the present invention with the actuator arm in the home or rest position.

FIG. 1 illustrates the toggling jam detector switch according to the present invention which has a switch actuator enabling positive switch actuation by the passage of a sheet in downstream direction of the sheet transport path and passively movable to a second position by the removal of a sheet from the sheet transport path in the upstream direction. The switch 1 comprises a main switch body 2 having contained therein at least one switching element 3 such as a magnetically attractable element of a read switch to complete an electrical circuit and through electrical connection 15 to transmit to the machine logic the information that the circuit is completed or not completed. The switch includes an actuator mechanism 4 pivotally mounted about pivot 5 which includes an actuator arm 8 having at its free end a spring loaded actuator tip 9 pivotally mounted to the actuator arm 8 about pivot 10 and spring biased to the closed position against stop 14 on actuator arm 8 by spring 11 mounted between spring mounts 12 and 13. The switch actuator also includes a second arm 6 also pivotally mounted about pivot 5 such that the non-mounted or free end of the arm which contains a switch actuator element such as a magnet 7 is freely and pivotally movable into switching association with the switching element on the main switch body. The free ends of the actuator arm and the second arm 6 are spaced apart and in fact when it may be made from one piece molded plastic.

Briefly and as will be described in greater detail hereinafter, the main machine switch body is generally vertically oriented in the the sheet transport path and a switch actuator is maintained in the rest position by gravity when there is no sheet in the transport path. In the closed or rest position, the electrical circuit is completed. When a sheet enters a transport path, it engages the actuator tip swinging it about the pivot upwardly breaking the contact between the switching element in the main switch body and the switch actuator element in the second arm which condition is automatically transmitted to the machine logic. In the event of a paper jam and the subsequent removal of the jam from the transport path in the downward direction, the switch actuator rotates downwardly to the home or rest position by the frictional interaction between the end of the actuator tip and the paper in the paper path. However, as the paper continues to be withdrawn from the paper path, this frictional interaction between the paper and the end of the actuator tip is sufficient to rotate the actuator tip about pivot 10 out of the paper path so that the paper may be withdrawn without the actuator tip piercing, tearing or otherwise damaging the paper. Once the paper has cleared the paper path, the bias from spring 11 automatically returns the actuator tip to its extended position on actuator arm 8 against stop 14.

Figure 2:
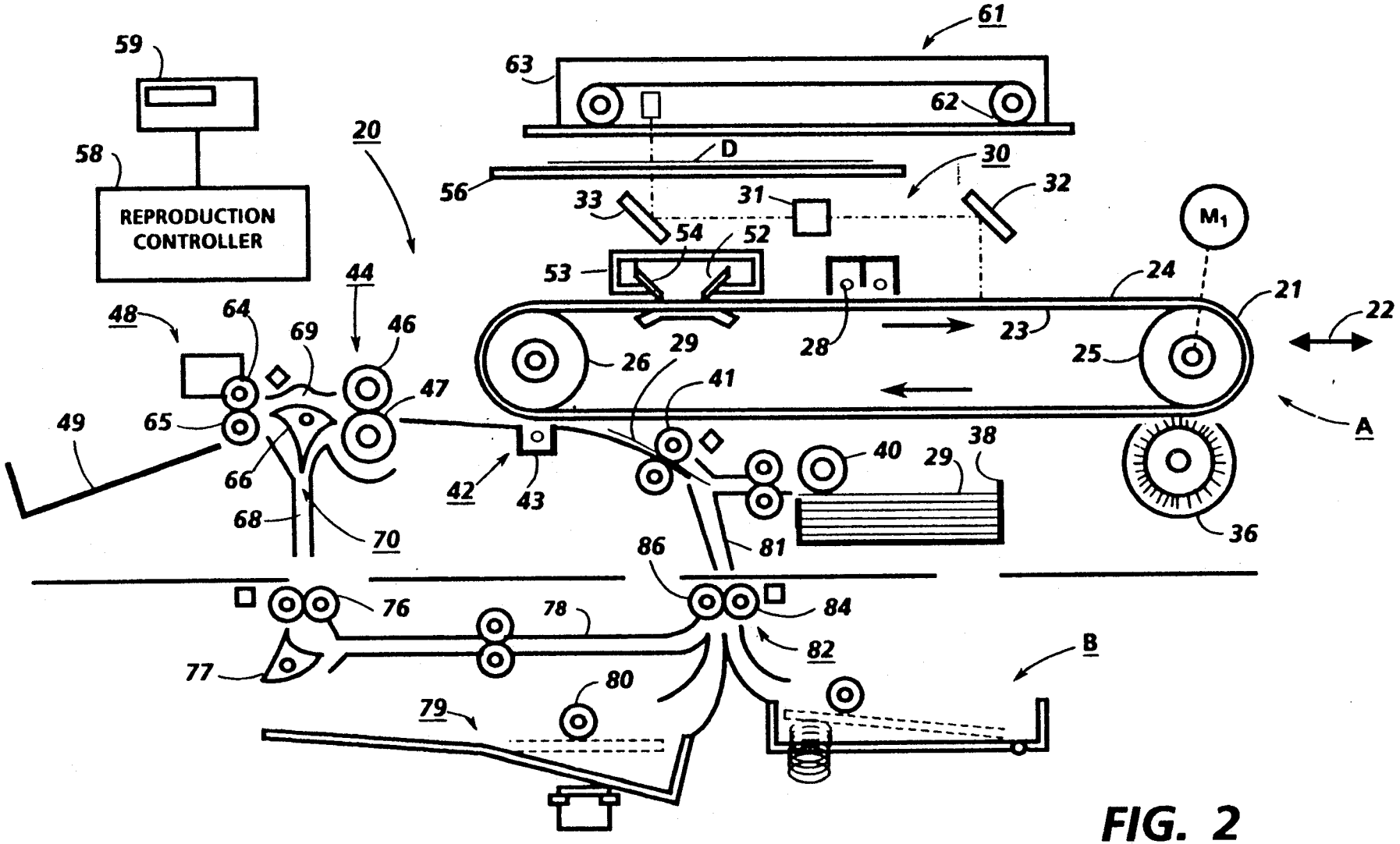
FIG. 2 is a schematic representation in cross section of an automatic printing machine which may include the jammed detection switch according to the present invention.

FIG. 2 is representative of electrostatographic printing machines which may embody a sheet transport apparatus having the toggled jam detection switch, according to the present invention. It will be understood that while the invention is described with respect to a specific embodiment that is equally well suited for use in a wide variety of other apparatus having sheet transport apparatus and it is not necessarily limited in application to the particular embodiment or embodiments shown herein.

The printing machine 20 illustrated in FIG. 2 employs a removable processing cartridge 21 which may be inserted and withdrawn from the main machine in the direction of arrow 22. Cartridge 21 includes a belt like photoreceptor member 23, the outer periphery of which is coated with a suitable photoconductive material 24. The belt is driven about transport rolls 25 and 26, and travels in the direction indicated to bring the image bearing surface thereon past the plurality of conventional xerographic processing stations. Suitable drive means such as motor $M_1$ are provided to power and coordinate the motion of the various cooperating machine components whereby a reproduction of the original input image information is recorded upon a copy sheet 29, such as a paper or the like.

Initially, photoreceptor 23 is uniformly charged with an electrostatic charge placed on the photoconductive surface 24 by charge corotron 28 in a known manner. Thereafter photoreceptor 23 is exposed to the light from the input image whereby the charge is selectively dissipated in the light exposed regions to record the input image in the form of electrostatic latent image. The document is scanned with a multimirror scanning optics system 30 of a type well known in the art including stationary lens 31 and a pair of cooperating movable scanning mirror 32, 33. The scanning mirrors include a half rate mirror 32 and a full rate mirror 33 supported on carriages (not shown) for scanning movement. A magnetic brush development system, including developer roll 36, utilizing a magnetizable developer mix having coarse magnetic carrier granules and toner colorant particles develops the image.

Paper sheets 29 are supported in a stack arrangement on elevated stack support tray 38. With the stack at its elevated position, the sheet separator feed roll 40 feeds individual sheets therefrom to the registration pinch roll pair 41. The sheet is then forwarded to the transfer station 42 in proper registration with the image on the belt, and the developed image on the photoconductive surface 24 is brought into contact with copy sheet 29 within the transfer station 42, and the toner image is transferred from the photoconductive surface 24 to the contacting side of the copy sheet 29 by means of transfer corotron 43. Following transfer of the image, the copy sheet, which may be paper, plastic, etc., as desired, is separated from photoreceptor 23 by the beam strength of copy sheet 29 as it passes around the curved face of photoreceptor 23 around the transport roller 26 and the copy sheet containing the toner image thereon is advanced to fusing station 44 wherein the transferred powder image is affixed to the copy sheet by being transported between an internally heated fuser roll 46 in contact with the toner image and backup pressure roll 47. After fusing the toner image to the copy sheet, copy sheet 29 is advanced tot he reversible exit nip 48 from where it may be directed to sheet stacking tray 49 or to the input of a sorter (not shown) or directed to the duplex path.

Residual toner remaining on the photoconductive surface 24 after the transfer of the toner image to the final support material is removed from the belt 23 by cleaning blade 52 in scrapping contact with the outer periphery of the belt 23, and contained within cleaning housing 53 which has a cleaning seal 54 associated with the upstream opening of the cleaning housing.

In the conventional mode, original document D to be reproduced is placed on platen 56 which is scanned by optics 30 which directs light from the document to the photoreceptor 23 for copying. The speed of photoreceptor 23 and scanning optics 30 are synchronized to provide for accurate reproduction of the document.

Reproduction processor controller 58 is preferably a known programmable controller or combination of controllers, which conventionally controls all of the other machine steps and functions described herein including the operation of the document feeder, the paper path drives in both the reproduction processor A and duplex module B etc. The controller 58 also conventionally provides for storage and comparisons of counted values including copy sheets and documents, and numbers of desired copies, and control of operations selected by an operator through alphanumeric display and control panel 59.

An automatic document feeder 61 is optionally provided and is controllable by the reproduction processor controller 58. Documents are fed into the device at document input 62 and are passed across platen 56 for copying, and exit the feeder at document output 63.

It is believed that the foregoing general description is sufficient for the purposes of the present application to illustrate the general operation of an automatic xerographic copier which can embody the apparatus in accordance with the present invention. It will be appreciated that while the present invention finds particularly advantageous use with respect to the described arrangement, the principles of operation may be used in many other embodiments.

Figure 3:
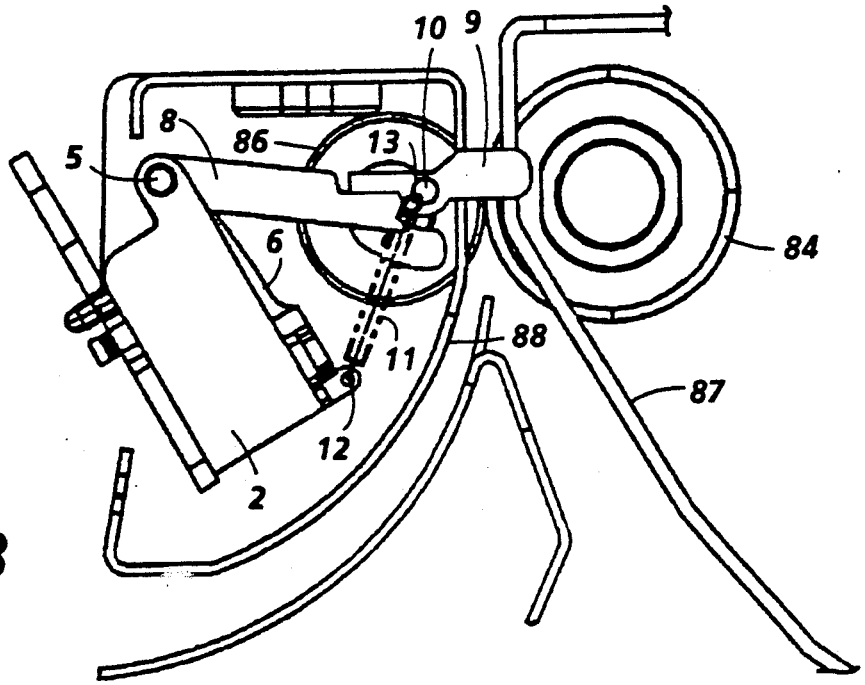
FIGS. 3–5 are enlarged cross sectional views showing portions of a sheet transport apparatus wherein the actuator arm of the switch according to the present invention is in the home or rest position the maximum lift position, or the jam removal position respectively.

With continued reference to FIG. 2 and additional reference to FIG. 3, the duplex module and paper path are illustrated. The reversible exit nip 48 is provided with a motor (not shown) for driving roller 64 in forward, reverse and stop motion. The motor may advantageously be a stepper motor of the sort well known in the art. Reproduction processor controller 58 instructs the motor to drive the drive roller 64 of the exit nip 48 as required by the copying function in process. Thus, for simplex copying of a document, or completed duplex copying of a document, roller 64 is driven in a forward direction to drive copy sheet to output tray 49 thereby serving as an output driver. In the case where the copy sheet is required to receive a second side image for a duplex copy, roller 64 is driven first in a forward direction until the copy sheet trail edge has cleared deflector 66, and subsequently in reverse direction to drive the copy sheet back into reproduction processor 20 through the duplex module B. The process of changing direction while the copy sheet is in exit nip 48 serves to change the trail edge of the copy sheet to the lead edge to enable inversion of the document to receive a second side copy. In certain cases, it will be desirable to hold a copy sheet while the processor advances previously returned copy sheets in order to correctly time the return of all the copy sheets to the processor for receiving a second image. In this case, roller 64 is stopped and the copy sheet is held between rollers 64, 65 until a control signal is received from controller 58 by the motor, directing it to drive the paper in either forward or reverse motion.

As mentioned previously controller 58 may be responsive to a variety of sensing devices such as paper size sensors, edge sensors, etc., to further enhance its control of the reproduction machine.

In operation, reversible exit nip 48 receives copy sheets between rollers 64 and 65 from fuser station 44. For duplex copying, the copy sheet is passed thereinbetween until the trailing edge clears deflector 66 in the copy sheet path 69. When the sheet has cleared deflector 66, rollers 64 and 65 change driving direction to direct the sheet into duplex module copy sheet path 68, whereby the trailing edge of the copy sheet is changed to the leading edge, for the normal sheet reversal or lead edge to trail edge inversion for standard duplex copying, which provides the duplex paper path with an odd number of inversions. Deflector 66 is situated slightly higher than the reversible exit nip, and extends into the paper path 69 to direct returning copy sheets into duplex path 68. In some embodiments, the deflector 66 maybe movable to block sheet access to the reversible exit nip and direct sheets to duplex path 68, in order to allow sheets to be returned to the reproduction processor without reversal and with two natural inversions, to return the sheet with the same side available for color or image overlay copying.

Copy sheets are passed to the duplex module entry nip 76 in the duplex module B. On passing duplex module entry nip 76, duplex deflector baffle 77 serves to direct copy sheets to either trayless path 78 or duplex tray 79. When duplex deflector baffle 77 is in place to block entry of copy sheets into the trayless path 78, copy sheets are directed into duplex tray 79. Copy sheets passed to duplex tray 79 are refed therefrom by sheet feeder 80 to reproduction processor A through duplex module exit nip 82, and returns to path 81, with a natural single inversion to re-enter the reproduction processor module A for receiving a second side copy.

As may be observed with reference to FIG. 2, there are numerous sheet transport paths provided where difficulties with regard to sheet jamming could occur and where it would be desirable to determine whether at any particular point in time in fact a sheet was present or not present so the machine logic could operate properly. Representative of such a location is the nip formed between driven take-away roll 84 and pinch roll 86 in the sheet transport path 81 from both the trayless duplex path and the duplex tray which is more clearly represented with reference to FIGS. 3, 4, 5 and 6 to which attention is now directed.

For additional details with reference to the manner of operation of the illustrated electrostatographic printing machine, attention is directed to U.S. Pat. No. 4,727,40 Partilla et al. and U.S. Pat. No. 4,727,397 to Stemmle.

Figure 4:
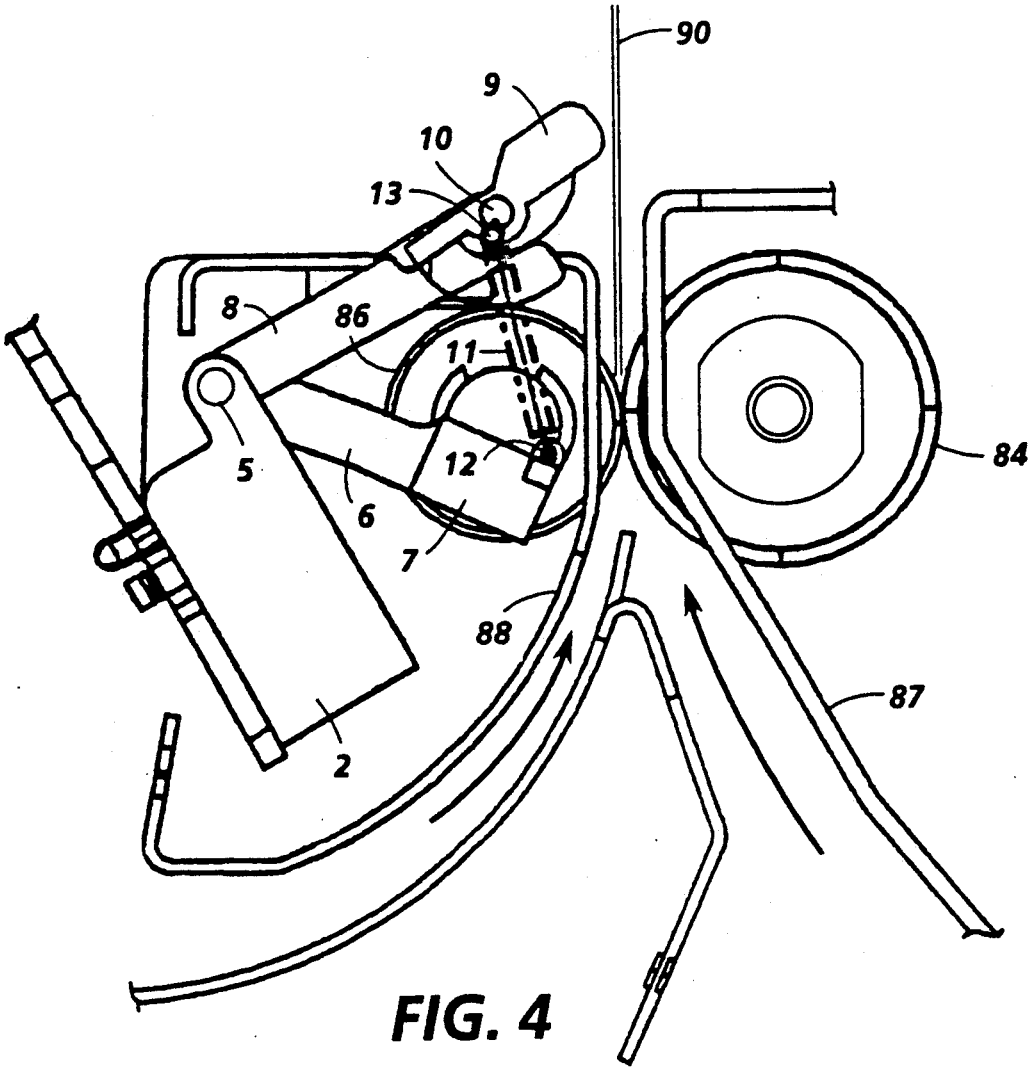
Figure 5:
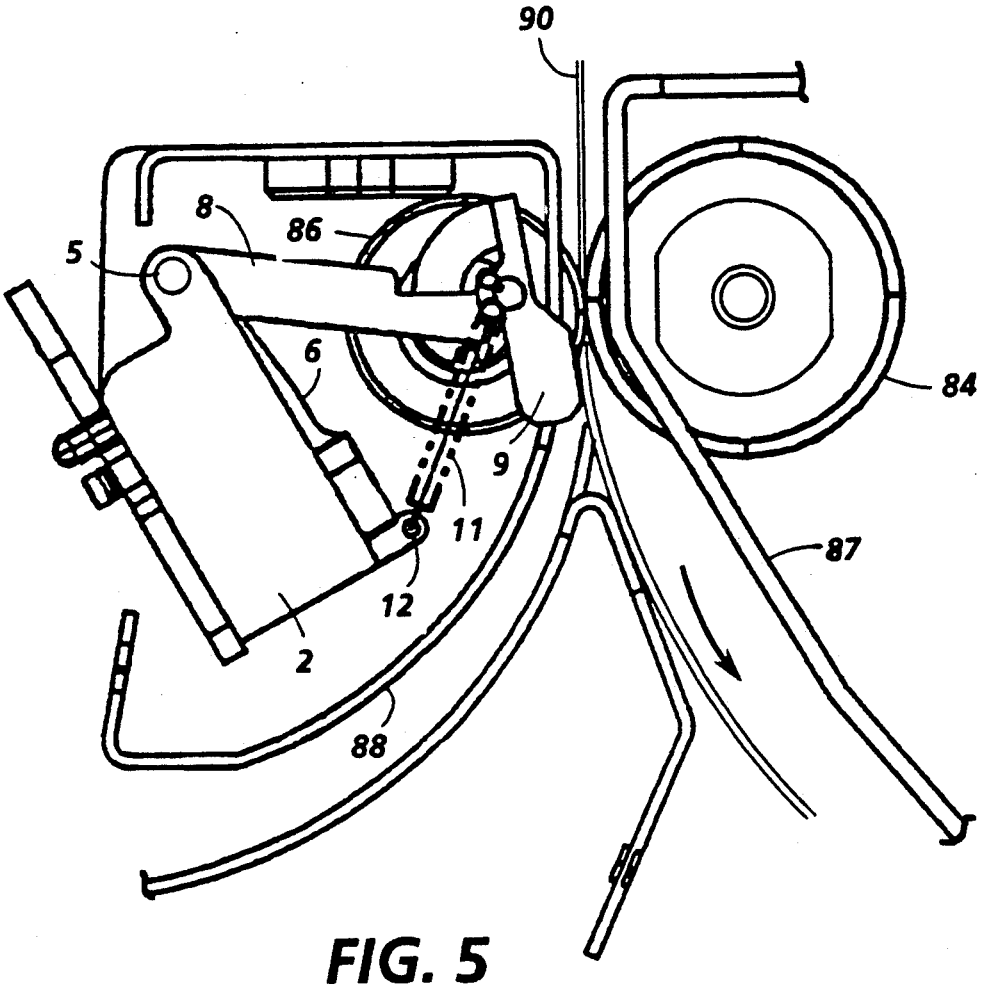

FIGS. 3, 4 and 5 are is a sectional views illustrating for the toggled jammed detector switch according to the present invention in the sheet transport path of apparatus illustrated for example in FIG. 2. In the Figures the switch is mounted in part of the retain path 91 defined by guide baffles 87 and 88 substantially along the axis of a pair of driven takeaway rolls 84 and pinch rolls 86. In the home position, illustrated in FIG. 3 the actuator tip extends into the paper path and indeed with particular reference to FIG. 6 extends into an opening 88 in the opposing guide baffle 87 forming with that opening a geometric configuration which tends to corrugate the sheet passing through the transport path. This corrugation or overlap is necessary in order to obtain accurate detection of the sheet in the paper path. In the rest position, the switch is closed and the machine logic is aware that there is no paper at the switch location. FIG. 4 schematically illustrates the situation wherein a sheet 90 has been fed from either the trayless path or the duplex path with the actuator tip pivoting the actuator arm upwardly about the pivot on the main switch body breaking the contact between at least one switching element in the main switch body and the switch actuator element thereby actuating the switch and informing the machine logic that a sheet is in the paper path at the location of the switch.

Figure 6:
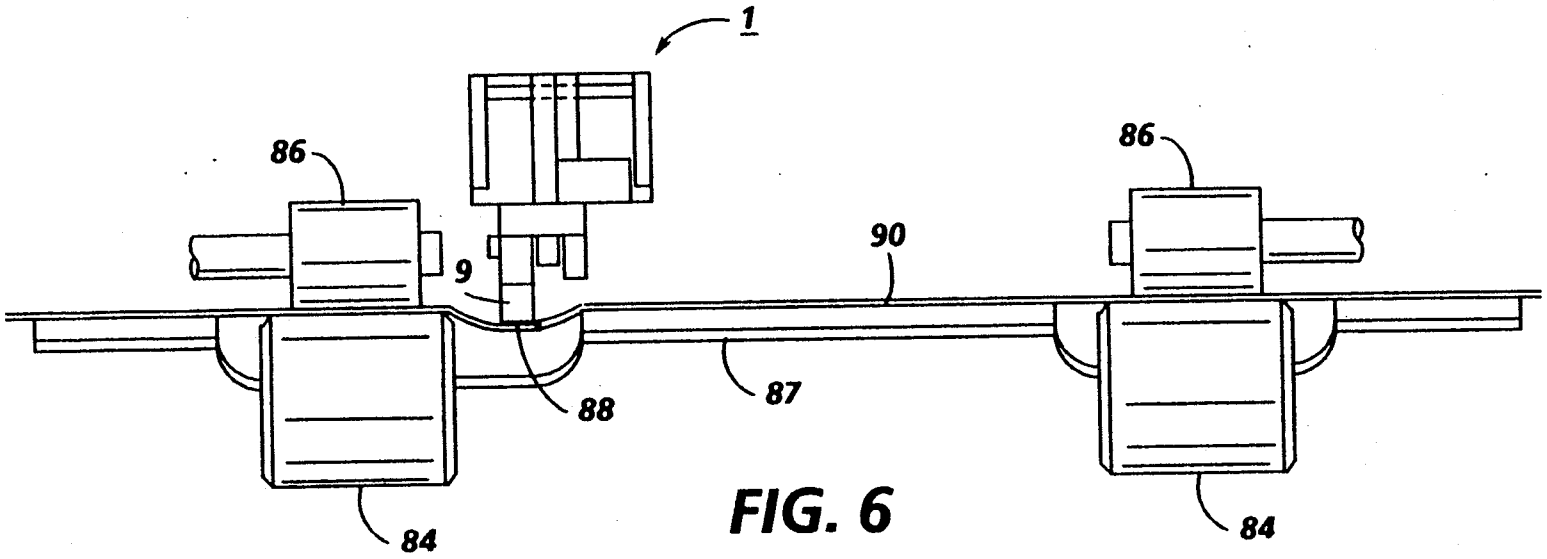
FIG. 6 is a top view of the sheet transport apparatus showing creation of a corrugation in a sheet being transported.

If after a programmed period of time, the switch is not once again closed, the controller may shut the machine down and provide an indication that there is a paper jam at the location of the switch. FIG. 5 illustrates the operation of the toggled jam detection switch according to the present invention which provides a positive indication of the presence of the sheet in the paper path at the switch location and also on jam removal as illustrated in FIG. 5 the rotation of the actuator tip out of the paper path during jam removal thereby eliminating paper damage by way of piercing or tearing the sheet. Accordingly, upon the initiation of removal of the jammed sheet from the bottom in the direction of the arrow, the actuator tip which is in frictional interaction with the paper is urged downwardly a result of such frictional action to the home or rest position at which point it provides a corrugation or overlap in the paper path as illustrated in FIG. 6. Upon further removal of the jammed sheet this frictional interaction with the sheet tends to pivot the actuator tip about its pivot downwardly out of the sheet transport path thereby avoiding damages to the sheet by tearing or piercing. Once the jammed sheet has been cleared from the transport path, the spring returns the actuator tip to the home or rest position.

The present invention accordingly provides a positive location of the actuator tip in the sheet feeding direction or normal process direction while at the same time enabling jam clearance of a jammed sheet in the sheet transport path in an opposite direction by enabling the passive rotation of the same actuator tip about a pivot point on the end of the actuator arm. The invention has the further advantage of increased actuation reliability because of the increased overlaping penetration or corrugation that is permitted as a result of the passive movement of the actuator tip during jam removal.

The disclosures of the patents referred to herein are specifically and totally incorporated herein by reference. While the invention has been described with reference to specific embodiments it will be apparent to those skilled in the art that many alternatives, modifications and variations may be made. For example, while the invention has been illustrated with reference to a reed switch it could be equally well used with conductive contacts on the main switch body to complete the circuit. Accordingly, it is intended to embraced all such modifications and alternatives as may fall within the spirit and scope of the appended claims.

We claim:

1. A Sheet transport apparatus comprising opposed sheet transport guide baffles defining a sheet transport path having an upstream and downstream direction, a switch adjacent said path to detect the presence of a sheet in said path, said switch comprising a main switch body fixedly mounted adjacent said path, a switch actuator movable between a rest position and a switch actuated position including an actuator arm having a free end and being pivotally mounted on an actuator pivot at the other end to said main switch body and movable between a position associated with said rest position and switch actuated positions, a switch actuator tip pivotally mounted to the free end of said actuator arm and movable between a first position extending the length of said arm into said path detecting the presence of a sheet in said path and a second position pivoted toward the sheet transport upstream direction out of said sheet transport path, said actuator tip being spring biased to said first position enabling positive switch actuation by the passage of a sheet in the downstream direction of said path and passively pivotally movable in a direction opposite to the pivot direction of the actuator arm when the actuator arm is in its rest position to said second position against said bias by the removal of a sheet from said path in the upstream direction.

2. The apparatus of claim 1 wherein said sheet transport guide baffles define a generally vertically oriented sheet transport path.

3. The apparatus of claim 2 wherein said switch is so mounted adjacent said path so as to maintain said actuator in the rest position by gravity when there is no sheet in the transport path.

4. The apparatus of claim 1 wherein said switch actuator includes a second arm having a free end and being fixed to said actuator arm and pivotally mounted on said actuator pivot, the free ends of said actuator arm and said second arm being fixedly spaced apart, said second arm having a switch actuator element on its free end, said main switch body having at least one switching element, said switch actuator element said at least one switching element being positioned respectively on said second arm and said switch body for switching association therebetween.

5. The apparatus of claim 4 wherein said at least one switch element comprises at least one magnetically attractable element and said switch actuator element comprises a magnet.

6. The apparatus of claim 4 wherein said switch actuator includes a second arm having a free end and being fixed to said actuator arm and pivotally mounted on said actuator pivot, the free ends of said actuator arm and said second arm being fixedly spaced apart, said second arm having a switch actuator element on its free end, said main switch body having at least one switching element, said switch actuator element and mail at least one switching element being positioned respectively on said second arm and said switch body for switching association therebetween.

7. The apparatus of claim 6 wherein said at least one switching element comprises at least one magnetically attractable element and said switch actuator element comprises a magnet.

8. The apparatus of claim 1 wherein said apparatus includes at least one sheet drive and pinch roll pair to transport a sheet between said baffles along said transport path.

9. The apparatus of claim 8 wherein said main switch body is mounted on one side of said transport path and said actuator tip when in the rest position extends across the transport path into an opening in the opposed guide baffle forming therewith a sheet corrugating geometry.

10. A switch comprising a main switch body, a switch actuator movable between a rest position and a switch actuator position including an actuator arm having a free end and being pivotally mounted at the other end to said main switch body and movable between a position associated with said rest position and said switch actuated position, a switch actuator tip pivotally mounted to the free end of said actuator arm and movable between a first position extending the length of said arm and a second position pivoted toward said main switch body, said actuator tip being spring biased toward said first position enabling positive switch actuation and passively pivotally movable in a direction opposite to the pivot direction of the actuator arm when the actuator arm is in its rest position to a second position against said bias.

11. A switch assembly comprising a main switch body having at least one switching element, an actuator element for said at least one switching element to complete an electrical circuit, said actuator element being mounted on an actuator arm pivotally mounted to said main switch body for movement between a rest position and a switch actuated position and for movement of said actuator element into and out of switching association with said at least one switching element, said actuator arm having an actuator tip pivotally mounted about its free end, said actuator tip being spring biased to a first normal position enabling positive switch actuation and being passively pivotally movable in a direction opposite to the pivot direction of the actuator arm when the actuator arm is in its rest position to a second position against said bias.

12. The apparatus of claim 11 wherein said at least one switch element comprises at least one magnetically attractable element and said switch actuator element comprises a magnet.

13. A printing machine comprising means to form an image on a sheet substrate, means to transport said sheet substrate through said machine said transport means comprising opposed sheet transport guide baffles defining a sheet transport path having an upstream and downstream direction, a switch adjacent said path to detect the presence of a sheet in said path, said switch comprising a main switch body fixedly mounted adjacent said path, a switch actuator movable between a rest position and a switch actuated position including an actuator arm having a free end and being pivotally mounted on an actuator pivot at the other end to said main switch body and movable between a position associated with said rest position and switch actuated positions, a switch actuator tip pivotally mounted to the free end of said actuator arm and movable between a first position extending the length of said arm into said path detecting the presence of a sheet in said path and a second position pivoted toward the sheet transport upstream direction out of said sheet transport path, said actuator tip being spring biased to said first position enabling positive switch actuation by the passage of a sheet in the downstream direction of said path and passively pivotally movable in a direction opposite to the pivot direction of the actuator arm when the actuator arm is in its rest position to said second position against said bias by the removal of a sheet from said path in the upstream direction.

14. The machine of claim 13 wherein said sheet transport guide baffles define a generally vertically oriented sheet transport path.

15. The machine of claim 14 wherein said switch is so mounted adjacent said path so as to maintain said actuator in the rest position by gravity when there is no sheet in the transport path.

16. The machine of claim 13 wherein said switch actuator includes a second arm having a free end and being fixed to said actuator arm and pivotally mounted on said actuator pivot, the free ends of said actuator arm and said second arm being fixedly spaced apart, said second arm having a switch actuator element on its free end, said main switch body having at least one switching element, said switch actuator element and said at least one switching element being positioned respectively on said second arm and said switch body for switching association therebetween.

17. The machine of claim 16 wherein said at least one switch element comprises at least one magnetically attractable element and said switch actuator element comprises a magnet.

18. The machine of claim 13 wherein said apparatus includes at least one sheet drive and pinch roll pair to transport a sheet between said baffles along said transport path.

19. The machine of claim 18 wherein said main switch body is mounted on one side of said transport path and said actuator tip when in the rest position extends across the transport path into an opening in the opposed guide baffle forming therewith a sheet corrugating geometry.

* * * * *